United States Patent [19]

Scholl et al.

[11] 4,122,785

[45] Oct. 31, 1978

[54] WORKPIECE SUPPORT FOR SEWING DEVICES

[75] Inventors: Hans Scholl, Oerlinghausen-Lipperreihe; Horst Bernewasser, Steinhagen, both of Fed. Rep. of Germany

[73] Assignee: Kochs Adler AG, Bielefeld, Fed. Rep. of Germany

[21] Appl. No.: 800,709

[22] Filed: May 26, 1977

[51] Int. Cl.[2] ..... D05B 21/00

[52] U.S. Cl. ..... 112/121.15; 74/568 R; 269/54.1; 269/54.5

[58] Field of Search ..... 112/121.15, 121.11, 112/121.12; 269/54.1, 54.5; 74/568 R

[56] References Cited

U.S. PATENT DOCUMENTS

| | | | |
|---|---|---|---|
| 3,167,041 | 1/1965 | Briggs | 269/54.1 X |
| 3,496,891 | 2/1970 | Kosrow et al. | 112/153 X |
| 3,762,348 | 10/1973 | Junemann | 112/121.12 |
| 3,774,558 | 11/1973 | Scholl et al. | 112/121.12 |
| 3,788,533 | 1/1974 | Allen | 269/54.5 X |
| 3,799,087 | 3/1974 | Beamish et al. | 112/121.15 X |
| 3,828,703 | 8/1974 | Sugland | 112/121.15 |
| 3,936,923 | 2/1976 | Cantor | 269/54.5 X |

FOREIGN PATENT DOCUMENTS

| | | | |
|---|---|---|---|
| 1,485,124 | 8/1969 | Fed. Rep. of Germany | 112/121.12 |
| 658,439 | 10/1951 | United Kingdom | 112/121.15 |

*Primary Examiner*—H. Hampton Hunter
*Attorney, Agent, or Firm*—Max Fogiel

[57] ABSTRACT

A workpiece holder for sewing machines in which a plurality of supporting segments are located next to one another and are displaceable relative to each other. These supporting segments have a rim zone at which needles are located. The rim zone, furthermore, supports the edge of a workpiece to be processed. A device which may be lowered onto the workpiece, cooperates with the needles for holding the workpiece on the needle. A contour adjusting device is provided with templates for shifting the supporting segments. The templates have a contour corresponding to the seam to be applied to the workpiece. The supporting segments are, moreover, formed by rails having a U-shaped cross-section with cross bars carrying the workpiece and having recesses for permitting passage of the needles. The latter are arranged on a two-arm lever rotatably supported in each of the supporting segments, and they are held in a position permitting passage through the supporting segments within the recess by means of a spring.

5 Claims, 6 Drawing Figures

WORKPIECE SUPPORT FOR SEWING DEVICES

BACKGROUND OF THE INVENTION

The present invention relates to a workpiece support for use in sewing devices.

The present invention serves to arrest the workpieces to be inserted into a template-controlled sewing device on the workpiece support of the sewing device adjacent to the seam contour during sewing the seam.

The present invention also simplifies the changeover of the sewing device to workpieces of different size and/or different seam contour.

There are already know, i.e. from the German Laid Open Document No. 14 85 205, workpiece holding devices comprising clamping plates for use in Automatic sewing devices and for producing seams on workpieces of predetermined form and/or size.

Furthermore, in the German Utility Models Nos. 1 914 427 and 1 998 372, there are disclosed adjustable workpiece holding devices for use in automatic sewing devices. However, these known workpiece holding devices are only adjustable for receiving workpieces of different size but not for workpieces of different form.

Finally, from the U.S. No 3,828,703, there is known a workpiece holding device comprising a number of individual workpiece clamping holders for clamping the workpiece at its edges. Each of these proportionally narrow workpiece clamping holders comprises a workpiece supporting beam and a workpiece clamping plate hinged to one arm of a two-armed lever. This two-armed lever is pivoted in a jack, which is carried by the workpiece supporting beam, against the tension of a spring. Each workpiece clamping holders is displaceably and clampably supported in the sewing device, in order to be adjustable for receiving workpieces of different size and form.

It is true, the individual workpiece damping holders can be aligned easily, but this procedure is tedious, especially when changes of the workpiece form are often necessary. Preferably, this known device is adapted for small workpieces as the required passage for workpieces of large size between the upper workpiece supporting beams and the workpiece clamping plates is limited.

Therefore, it is an object of the present invention to provide means in automatic sewing devices adapted for receiving smaller and larger workpiece cuts on the workpiece support and arresting them thereon properly adjacent to the seam to be sewn and free from creases, and to facilitate a quick changeover to workpieces having a different seam contour.

Another object of the present invention is to provide an arrangement in automatic sewing devices of the foregoing character which is substantially simple in construction and may be economically fabricated.

A further object of the present invention is to provide an arrangement in automatic sewing devices, as described, which may be readily maintained in service and which has a substantially long operating life.

SUMMARY OF THE INVENTION

The objects of the present invention are achieved by providing a workpiece support comprising a number of side-by-side and displaceably arranged supporting segments, which are provided at their external zones with needles for carrying the edge of the workpiece to be sewn and cooperating with a device lowerable upon the workpiece and for arresting the workpiece on the needles.

For displacing the supporting segments there is provided a contour adjusting device formed with templates, which correspond with the seam contour to be produced on the workpiece. The supporting segments may be formed by rails having a U-shaped profile. The webs of the rails carrying the workpiece, are provided with recesses for the passage of the needles. The needles for arresting the workpiece are disposed at one arm of a two-armed lever pivoted in each supporting segment, and are kept by means of a spring in a position, at which the needles pass through the supporting segments within the recesses.

Along the length of the workpiece support, there is distributed a number of supporting segments, which are provided with stops for the edge of the workpiece. These stops are swingable downwards and connected to the two-armed levers in such a manner, that, when the needles are lowered below the surface of the supporting segments, the stops are swung upwards.

The aforesaid arresting device comprises a bristle brush extending along the whole length of the workpiece support and being lowerable upon the workpiece when the needles are in a position below the surface of the supporting segments.

The supporting segments, the two-armed levers for the needles, and the lever arrangement for the stops are arranged on supporting frames, which are received in guides and pressed under the tension of springs against the respectively adjusted template of the contour adjusting device. The supporting frames may be provided with cantilevers for the arrangement of tape carriers, in which there is received a tape-shaped template that is traced by a driven roller and determines the course of the contour.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
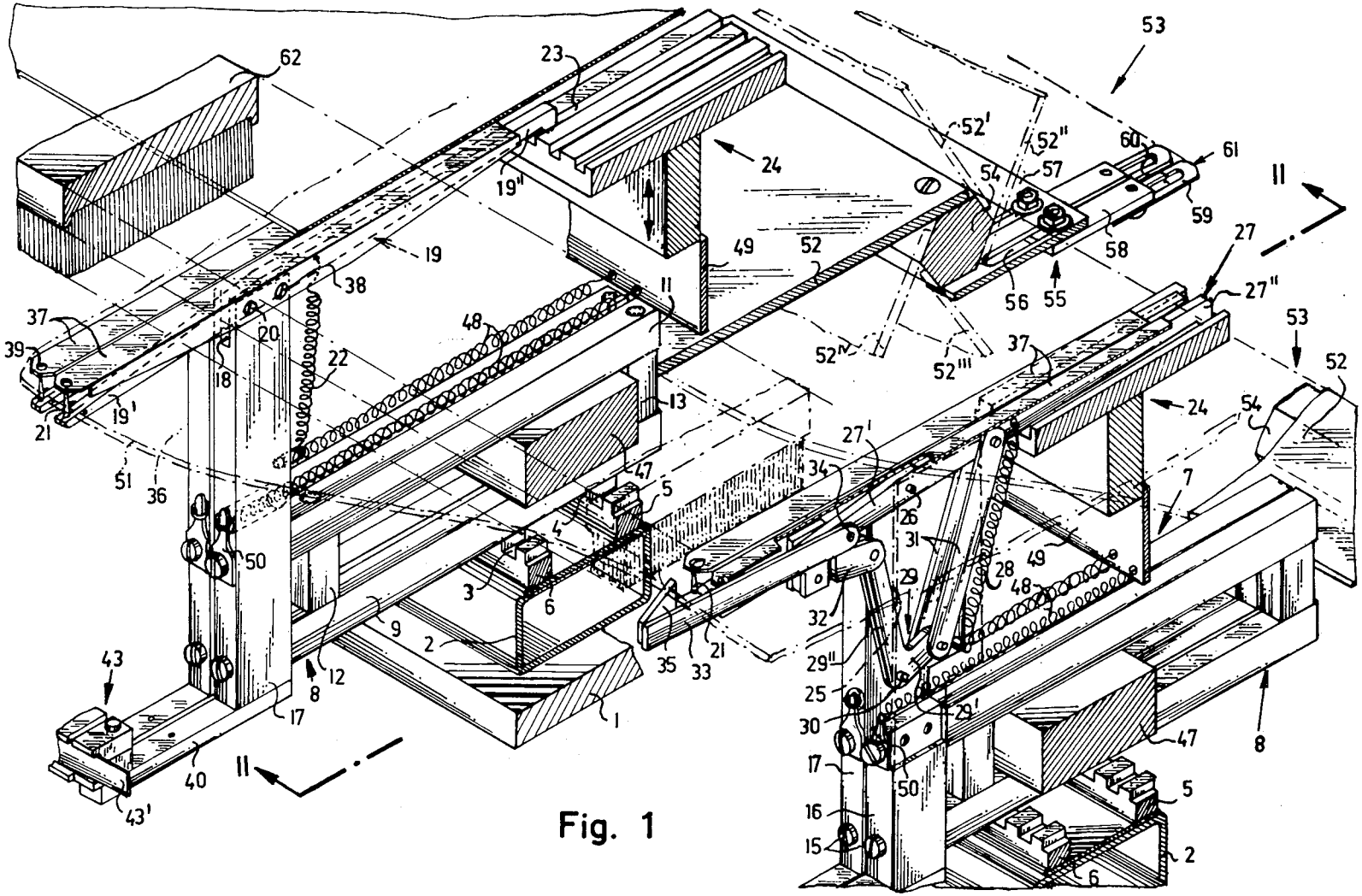
FIG. 1 is a perspective partial view of the workpiece support according to the present invention.

A plate 1 (FIGS. 1 and 2), which belongs to a frame of the sewing device (not shown), supports a carrier 2 which is provided with two rails 5, 6 having guide grooves 3, 4. The guide grooves 3, 4 are used for guiding support frames 7, 8 which are arranged next to each other and of which there is a large number. They are comprised of a lower rail 9 with a strip 10 (FIG. 2) engaging the guide grooves 3, 4, an upper rail 11, two spacers 12 and 13 located between the two rails 9 and 11, two screws 14 connecting the above parts, and support sections 16 and 17 (FIG. 1), which are fastened to rails 9 and 11 by means of screws 15. The support rails denoted by 7 are provided with support sections 17 which have a notch (cutout) 18 on the upper end. In this cutout there is mounted a two-arm lever 19 pivoting about a bolt 20; one arm 19' holds a needle 21 whose point is directed upward. The other arm 19'' of the two-arm lever 19 is under the tension of a spring 22 which pushes the end of arm 19'' . This end slides in a guide groove 23 of a lift plate 24. Fastened to the support sections 16 of the support frames 8 are two side sheet metal sections 25 between which a two-arm lever 27 is pivotably supported on a bolt 26 (FIGS. 1 to 6). This lever 27 on its one arm 27' also mounts a needle 21 with its point directed upward; its other arm 27'', under the load of a spring 28 and held in a guide groove 23, is pushed against the lift plate. Between the two side sheet metal sections 25 there is a bent lever 29 which is pivoted about a bolt 30; one arm 29' is hinged via a lever 31 to the arm 27'' of the two-arm lever 27, while its other arm 29'' is hinged via another lever 32 to a pivot arm 33 which is pivoted about a bolt 34 to arm 27' of the two-arm lever 27. The free end of pivot arm 33 holds a stop 35 for the workpiece 36.

To receive the workpieces, all support frames 7, 8 have receiving elements 37 which comprise relatively narrow U-shaped rails and are fastened by means of screws 38 or bolts 20, 26 to the support sections 17 or to the side sheet metal sections 25. The receiving elements 37, at their forward ends, have holes 39 for permitting needles 21 to pass.

Cantilever arms (FIGS. 1 and 2) are slidably fastened in slots 42 by means of screws 41 to the support sections 16, 17. The cantilever arms 40 are used for accommodating tape holders 43 in which there is an elastic tape 43' determining the shape of the contour as template for a driven roller 44 aligned with the sewing machine needle 45 of sewing machine 46.

The support frames 7 and 8 held in the guide grooves 23 are lined up on a carrier 47 located on the frame (not shown) of the sewing machine and are movable within narrow clearance between the carrier 47 and the rails 9 and 11. All support frames 7, 8 are pressed by means of tension springs 48 against a temple 52 which is adapted to the contour 51 of workpiece 36; this template is part of a contour adjusting device. The tension springs 48 are supported on one end on a plate fixed to the frame and on the other end on a support sheet metal section 50 screw-fastened to the support sections 16, 17.

The contour adjusting device 53 comprises a template carrier 54 which is held, intermittently rotatable, in a stand and is provided with a number of templates 52 to 52'''' or adjustable templates 55. Templates 52 to 52'''' have a fixed workpiece contour and are of one piece, while adjustable templates are adjustable totally or partially to the contour of the workpiece. The adjustable template has a plate 57 with slots 56 and is fastened to the template carrier 54. In the elongated holes 56 of plate 57, rail-shaped connecting links 58 are slidably screw-fastened to plate 57; the template elements 59 forming a template are arranged on these links. For shifting or adjustment, these template elements 59 have slotted holes 60 and their forward edges 61 form a stop for spacers 13 of support frames 7, 8.

The stand (frame) has a bristle brush 62 which can be lowered on all receiving elements 37. A control (not shown) is provided for the lifting movements of the bristle brush 62 and of lift plate 24.

The operation of a sewing device equipped with the workpiece holder of the present invention takes place as follows: In the basic positions drawn in FIGS. 1 and 3, due to the lifting of lift plate 24, the needles 21 located on the double-arm levers 19, 27 have been pivoted below the surface of the receiving elements 37. At the same time, on the support frames 8, distributed over the length of the workpiece holder, the pivot arms 33 which can be actuated via the lever arrangement 29 and 32 have been pivoted upward so that the stops 35 located there can act as stops for the workpiece.

Figure 4:
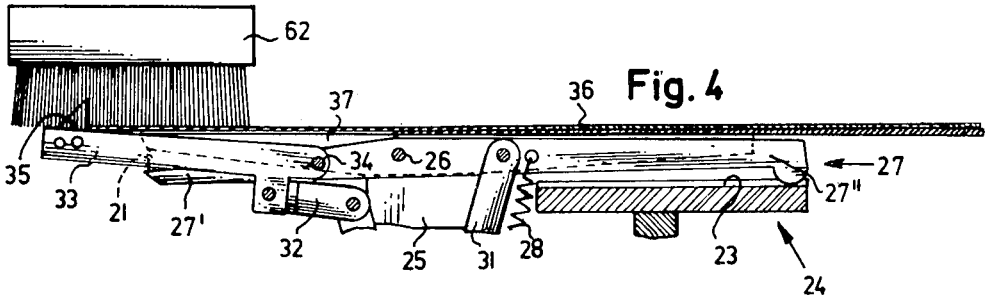
FIGS. 4 to 6 are sections according to FIG. 3, showing the swingable stops and needles in different working positions.
Figure 5:
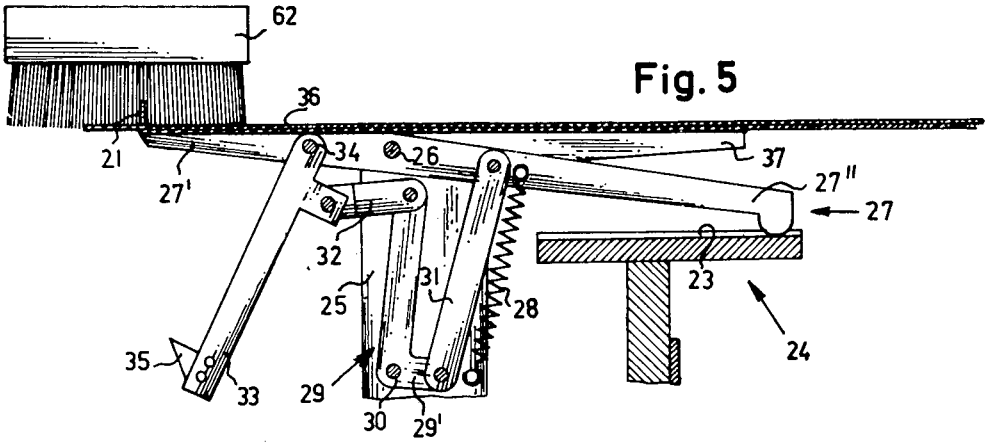

After placing the workpiece 36 on the support (receiving) segments 37, the bristle brush 62 is lowered onto workpiece 36, as shown in FIG. 4. By lowering the lift plate 24 (FIG. 5) the two-arm levers 19 and 27 under the action of springs 22 and 28, respectively, are pivoted such that needles 21 enter through the holes 39 in support elements 37, pass through the workpiece 36, and then hit the bristle brush 62 which holds the workpiece.

Figure 2:
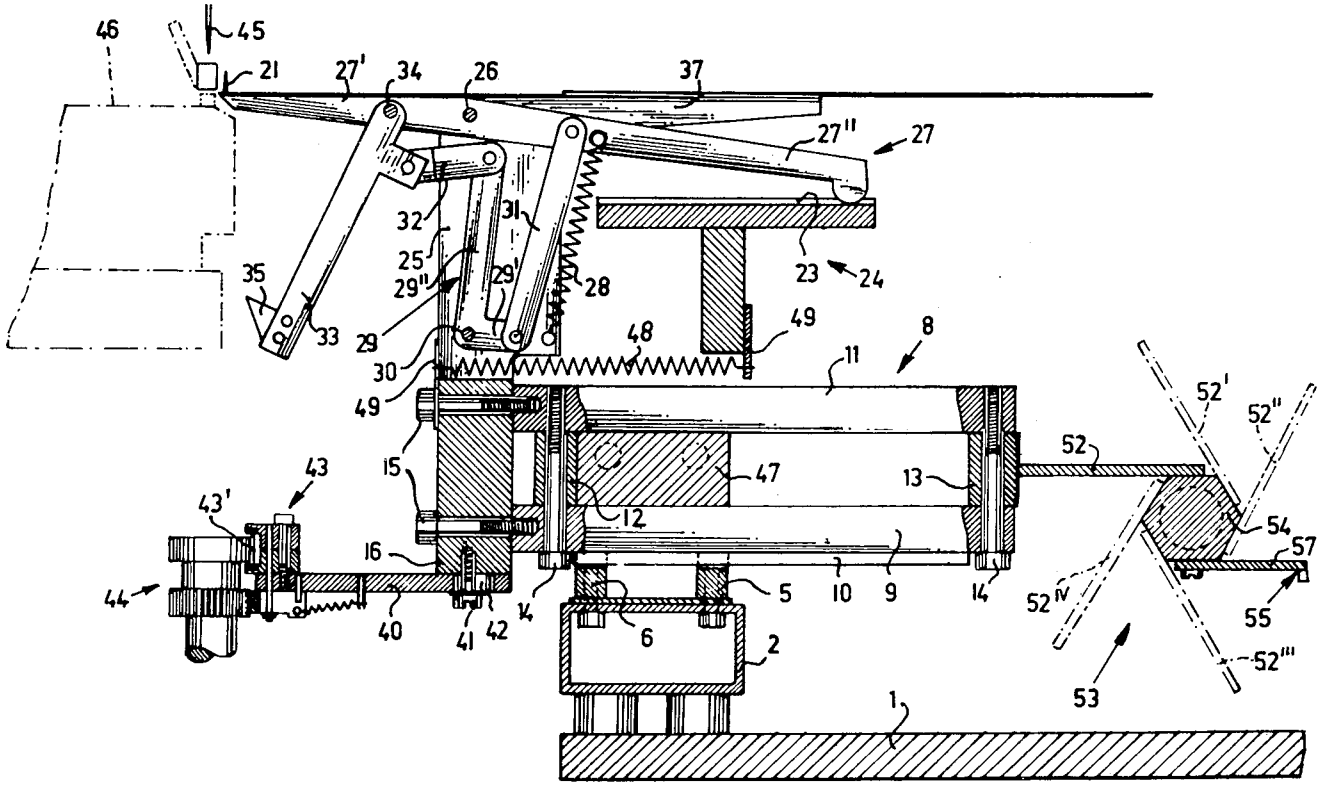
FIG. 2 is a section taken along line II—II of FIG. 1.
Figure 3:
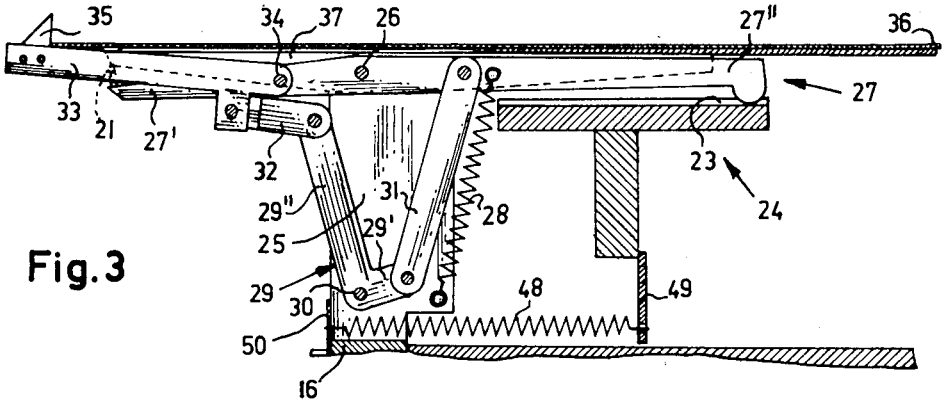
FIG. 3 is a partial section according to FIG. 2, however, showing the stop in a different position.
Figure 6:
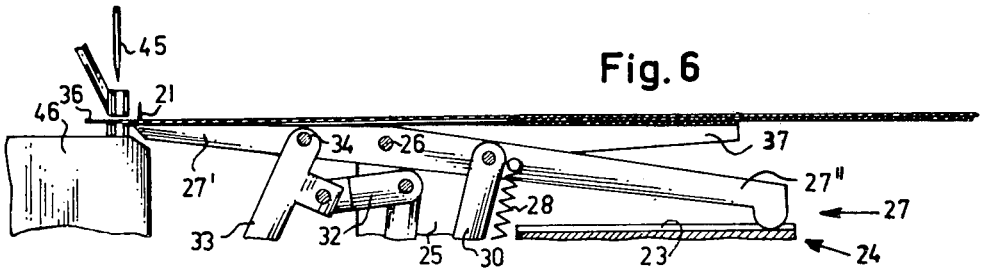

Because of the actuation of the two-arm levers 19 and 27, the pivot arms 33, hinged to levers 27, with stops 35 have been pivoted downward (FIG. 5), so that after lifting the bristle brush 62, these stops 35 are placed outside the path of motion of the sewing machine 46 then set into operation; by means of the driven roller 44, the sewing machine is guided along the tapeshaped template 43' and along the workpiece 36 (FIGS. 6 and 2).

The fact that the workpiece 36 is penetrated by the needles 21 only after the bristle brush has been lowered onto the workpiece 36, ensures that no creases (pleats) can be formed between the needles 21 and that, due to the many needles, it is held securely without additional clamps.

By turning the template carrier 54, the templates 52 to 52'''' , serving as stop for the support frames 7 and 8 and intended for predetermined contours, or the adjustable template comprising individual elements and hence adjustable, can be placed in the operating position.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention, and therefore, such adaptations should and are intended to be comprehended within the meaning and range of equivalence of the following claims.

What is claimed is:

1. A workpiece holder for sewing machines comprising a plurality of supporting elements located next to one another and displaceable relative to one another; needles located at a rim zone of said supporting elements for supporting the edge of a workpiece to be processed, and means lowerable onto the workpiece and cooperating with the needles for holding the workpiece on said needles; contour adjusting means having templates for shifting said supporting elements, said templates having contours corresponding to seams to be applied to said workpiece; said supporting elements comprising rails of U-shaped cross-section and having crossbars for carrying said workpiece, said crossbars having recesses for permitting passage of said needles; a two-arm lever rotatably supported in each of said supporting elements, said needles being arranged on said two-arm lever; and spring means for holding said needles in a position permitting passage through said support elements within said recesses, said workpiece being supported unclamped by said needles.

2. The workpiece holder as defined in claim 1, including stop means for the said edge of said workpiece and on a plurality of supporting elements distributed over the length of the workpiece holder; lever means connecting said stop means to said two-arm levers, said lever means being pivoted downward so that said stop means are pivoted upwards during lowering of said needles underneath the surface of said supporting elements.

3. The workpiece holder as defined in claim 1, wherein said means lowerable onto the workpiece comprises bristle brush means extending throughout the length of the workpiece holder, said bristle brush means being lowered onto said workpiece when said needles are in a position underneath the surface of said supporting elements.

4. A workpiece holder for sewing machines comprising a plurality of supporting elements located next to one another and displaceable relative to one another; needles located at a rim zone of said supporting elements for supporting the edge of a workpiece to be processed, and means lowerable onto the workpiece and cooperating with the needles for holding the workpiece on said needles; said supporting elements comprising rails of U-shaped cross-section and having crossbars for carrying said workpiece, said crossbars having recesses for permitting passage of said needles; a two-arm lever rotatably supported in each of said supporting elements and held in a position permitting passage through said supporting elements within said recesses by means of spring means; stop means for the edge of the workpiece and on a number of supporting elements distributed over the length of the workpiece holder; lever means for connecting said stop means to said two-arm levers, said lever means being pivoted downward so that said stop means are pivoted upward during lowering of said needles underneath the surface of said supporting elements; support frames held in rectilinear guides and mounting said supporting elements, said two-arm levers for said needles and said lever means for said stop means; and auxiliary spring means for pressing said support frames against the contours of said templates of said contour adjusting means.

5. The workpiece holder as defined in claim 4, including tape carriers holding a tape-shaped guide template to guide a driven guide roller for determining the shape of a sewn seam, said support frames having projecting arms for locating in position said tape carriers.

* * * * *